US005265395A

United States Patent [19]

Lalvani

[11] Patent Number: 5,265,395

[45] Date of Patent: Nov. 30, 1993

[54] NODE SHAPES OF PRISMATIC SYMMETRY FOR A SPACE FRAME BUILDING SYSTEM

[76] Inventor: Haresh Lalvani, 164 Bank St., Apt. 2B, New York, N.Y. 10014

[21] Appl. No.: 664,201

[22] Filed: Mar. 4, 1991

Related U.S. Application Data

[63] Continuation-in-part of Ser. No. 282,991, Dec. 2, 1988, Pat. No. 5,007,220, which is a continuation of Ser. No. 36,395, Apr. 9, 1987, abandoned.

[51] Int. Cl.[5] ..... E04H 12/00

[52] U.S. Cl. ..... 52/648.1; 403/176; 52/81.2

[58] Field of Search ..... 403/176, 171, 170, 217; 52/648, 311

[56] References Cited

U.S. PATENT DOCUMENTS

| | | | |
|---|---|---|---|
| 2,803,088 | 8/1957 | Swann | 403/176 |
| 3,632,147 | 1/1972 | Finger | 403/171 |
| 3,921,360 | 11/1975 | Baldwin | 403/171 |

FOREIGN PATENT DOCUMENTS

| | | | |
|---|---|---|---|
| 2457674 | 6/1976 | Fed. Rep. of Germany | 403/176 |
| 213713 | 5/1941 | Switzerland | 403/217 |
| 2187812 | 9/1987 | United Kingdom | 403/171 |

OTHER PUBLICATIONS

Zome Primer by Steve Baer pp. 1, 2, 16 20–23.

*Primary Examiner*—Henry E. Raduazo

[57] ABSTRACT

Families of node shapes based on prismatic symmetry for space frame constructions. The node shapes include various polyhedral, spherical, elipsoidal, cylindrical or saddle shaped nodes derived from polygonal prisms and its dual. The node shapes are determined by strut directions which are specified by various directions radiating from the center of a regular prism of any height. A plurality of such nodes is used in single-, double- or multi-layered space frames or space structures where the nodes are coupled by a plurality of struts in periodic or non-periodic arrays. The space frames are suitably triangulated for stability. Applications include a variety of architectural structures and enclosures for terrestrial or (outer) space environments. Suitable model-building kits, toys and puzzles are also possible based on the invention.

18 Claims, 16 Drawing Sheets

NODE SHAPES OF PRISMATIC SYMMETRY FOR A SPACE FRAME BUILDING SYSTEM

This application is a continuation-in-part of the application Ser. No. 07/282,991 filed Dec. 2, 1988, and now U.S. Pat. No. 5,007,220 entitled 'Non-periodic and Periodic Layered Space Frames Having Prismatic Nodes' (hereafter referred to as the "parent" application), which is a continuation of Ser. No. 07/036,395 filed Apr. 9, 1987 and now abandoned.

FIELD OF INVENTION

The invention relates to families of nodes shapes for space frame constructions based on prismatic symmetry. A plurality of such nodes is used in single-, double- or multi-layered space frames where the nodes are coupled by a plurality of struts arranged in periodic or non-periodic arrays. The space frames are suitably triangulated for stability where needed.

BACKGROUND OF THE INVENTION

Architectural space frames are among the novel developments in building systems in the present century. The advantages range from economy due to mass production, easy assembly due to repetitive erection and construction procedures, the integration of geometry with structure, and the development of new architectural form.

Numerous patents have been granted in this field. These patents range from new space frame geometries, new node shape designs to new coupling devices. These include U.S. Pat. Nos. 1,113,371 to Pajeau, 1,960,328 to Breines, 2,909,867 to Hobson, 2,936,530 to Bowen, 3,563,581 to Sommerstein, 3,600,825 to Pearce, 3,632,147 to Finger, 3,733,762 to Pardo, 3,918,233 to Simpson, 4,122,646 to Sapp, 4,129,975 to Gabriel, 4,183,190 to Bance, 4,295,307 to Jensen, and 4,679,961 to Stewart. Related foreign patents include U.K. patents 1,283,025 to Furnell and 2,159,229A to Paton, French patents 682,854 to Doornbos and Vijgeboom, 1,391,973 to Stora, Italian patent 581277 to Industria Officine Magliana and West German patents 2,305,330 to Cilveti and 2,461,203 to Aulbur. All these patents were considered in the allowance of the parent application. In addition, NASA's node for the Space Station structure based on cubic symmetry is cited.

The present application deals with node of prismatic symmetry and is an improvement of the allowed parent application with respect to further defining the shapes of nodes for the patented building system and specifying the techniques of triangulation necessary for stability purposes.

SUMMARY OF THE INVENTION

While the parent application described space frame systems having nodes of prismatic symmetry, the current application specifies shapes of nodes based on this type of symmetry. In addition methods of triangulation to provide stability in space frames composed of pin-jointed nodes are specified.

As stated in the parent application under the section 'Detailed Description of the Invention' (paragraph 3):

> "As used herein, a prismatic node means a node which is shaped as a prism and comprises top and bottom faces which are identical regular polygons with p sides, and p rectangles or squares forming side surfaces interconnecting the top and bottom surfaces. In addition, a prismatic node means any node having any shape or geometry derived from a prism and can include a sphere having strut directions derived from the prism geometry."

Further, in paragraph 6 of the same section in the parent application;

> "the shape of each prismatic node can be the p-sided prism with appropriate strut directions marked by holes, protrusions, beveling of corners or edges of the prism or any suitable polyhedron derived from the prism or a sphere."

Furthermore, the strut directions are specified by:

> the "combinations of directions from the center of a p-sided prism" (paragraph 11).

Building upon the above excerpt from the parent application, the present disclosure specifies classes of node shapes derived from various strut directions of a prism. These node shapes include various polyhedra derived from p-sided prisms and their duals by various trunactions of vertices and edges. Plane-faced and saddle polyhedral nodes based on the symmetry of the prism are disclosed. Additional node shapes based on the symmetry of the prism include various surfaces of revolution including spheres, ellipsoids, cylinders and other quadric and super-quadric surfaces.

For the purposes of illustration, the derivation of node shapes is shown for a limited combination of strut directions, and can be extended to other strut directions specified in the parent application. Further, a majority of the examples are shown as derivatives of p=5 case, with some illustrations from p=6, 7, 8, 10, 12 and 14. As in the parent application, the invention is restricted to odd values of p greater than 3 for both non-periodic and periodic arrays, and even values of p greater than 6 for non-periodic and greater than 8 for periodic arrays.

DRAWINGS

Referring to the drawings:

FIGS. 1*a*–1*e* show pentagonal prism with a 522 symmetry (p=5 case) and its 16 (i.e. $3p+1$) strut directions. When projected onto a sphere, ellipsoid or a cylinder, the symmetry, and hence the strut directions, are maintained.

FIG. 2 shows seven combinations of strut directions radiating from a sphere of prismatic symmetry 522 derived from FIG. 1*e*. The planes perpendicular to the axes are shown shaded.

FIG. 3 shows various polyhedral nodes of prismatic symmetry 522. Six of these are derived by different truncations of a pentagonal prism, and three are derived from a pentagonal bipyramid, the dual of a pentagonal prism. The faces of the polyhedra are perpendicular to different combinations of axes.

Figure 12A:
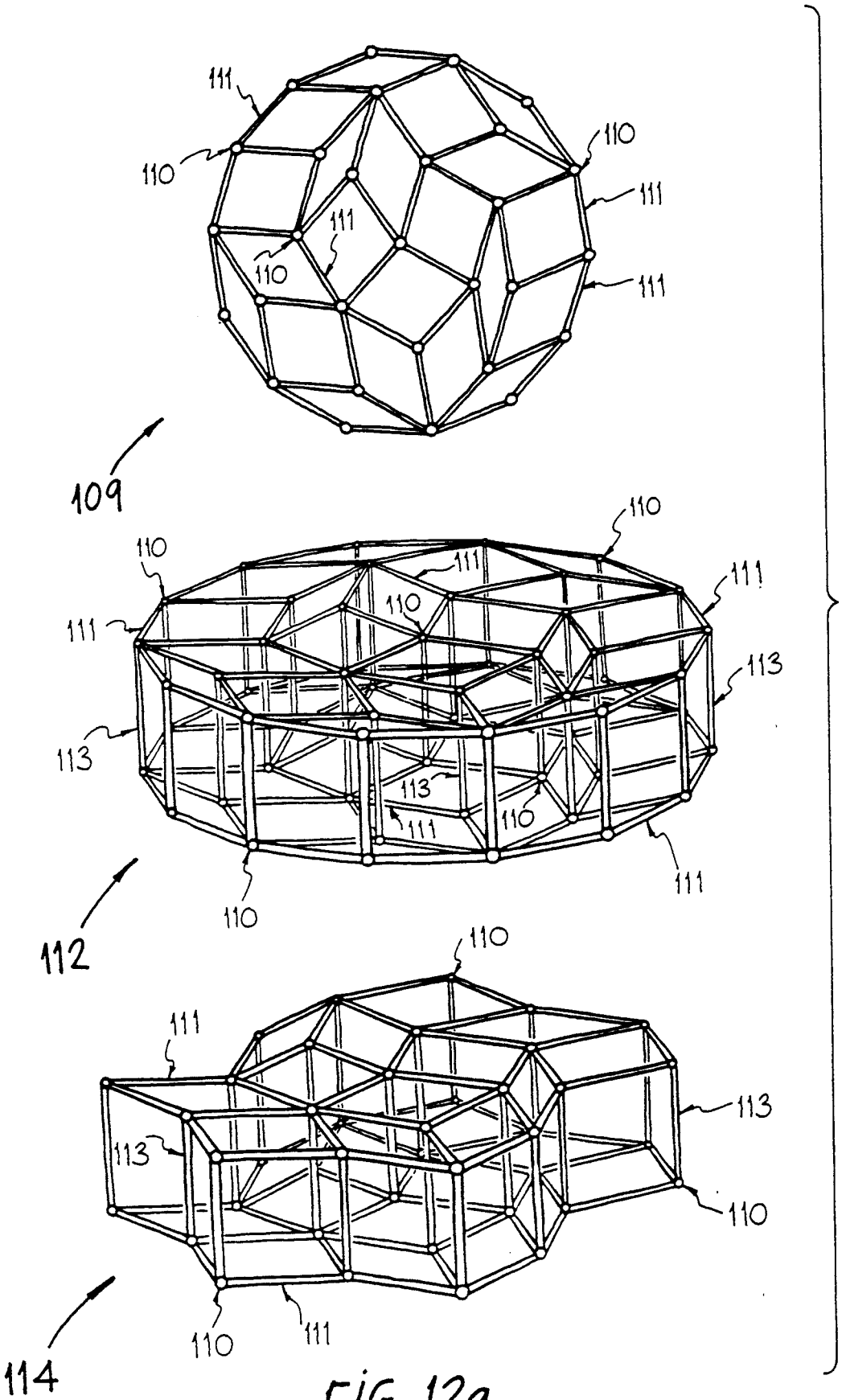
Figure 12B:
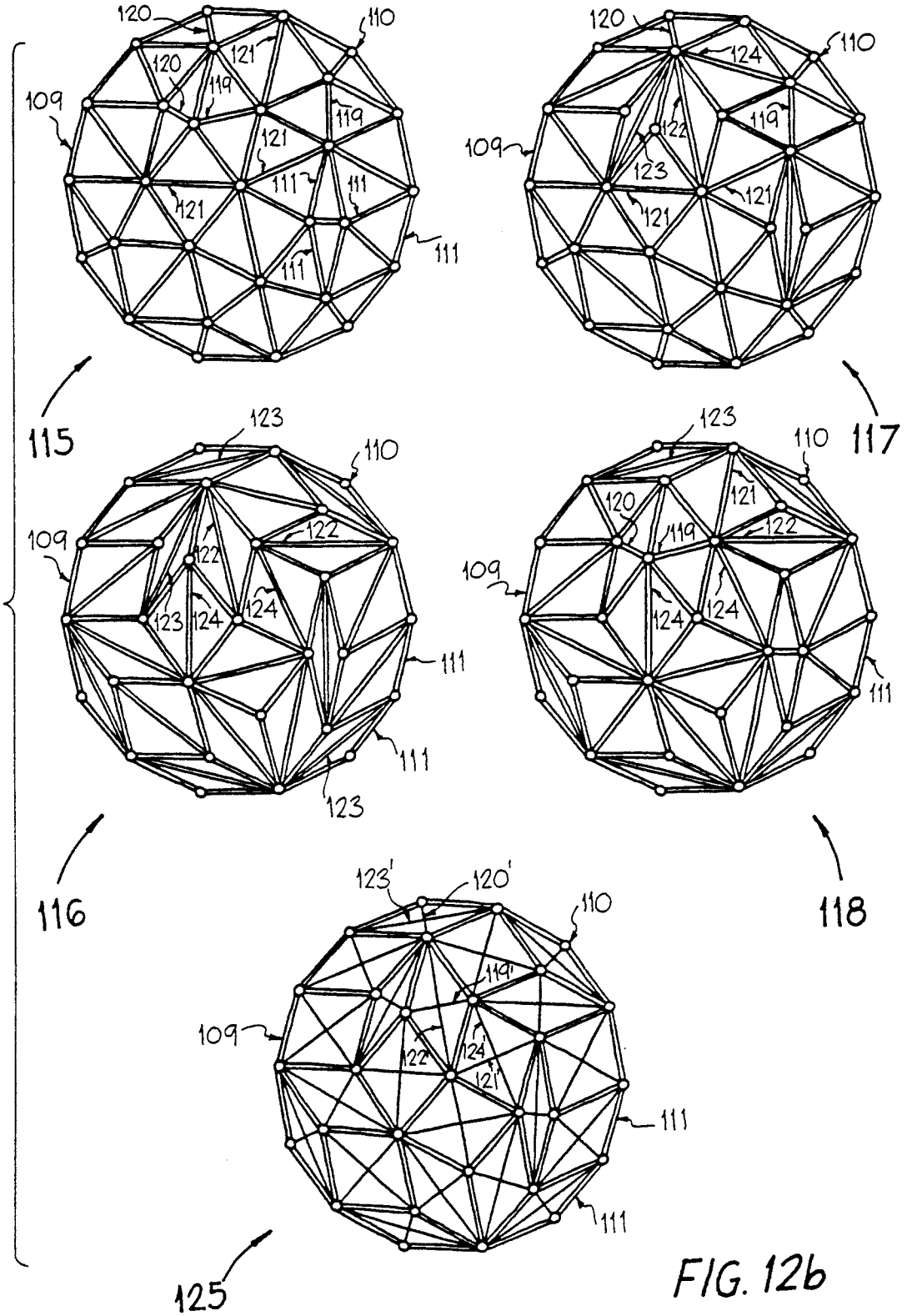

FIG. 12*a* shows a single-layered and two double-layered space frames constructed from nodes of p=7 or 14. The single-layered frame is composed or rhombii, and the double-layered frames are composed of rhombic prisms. FIG. 12*b* shows five different triangulations for the single-layered space frame constructed from p=7 or 14.

Figure 13:
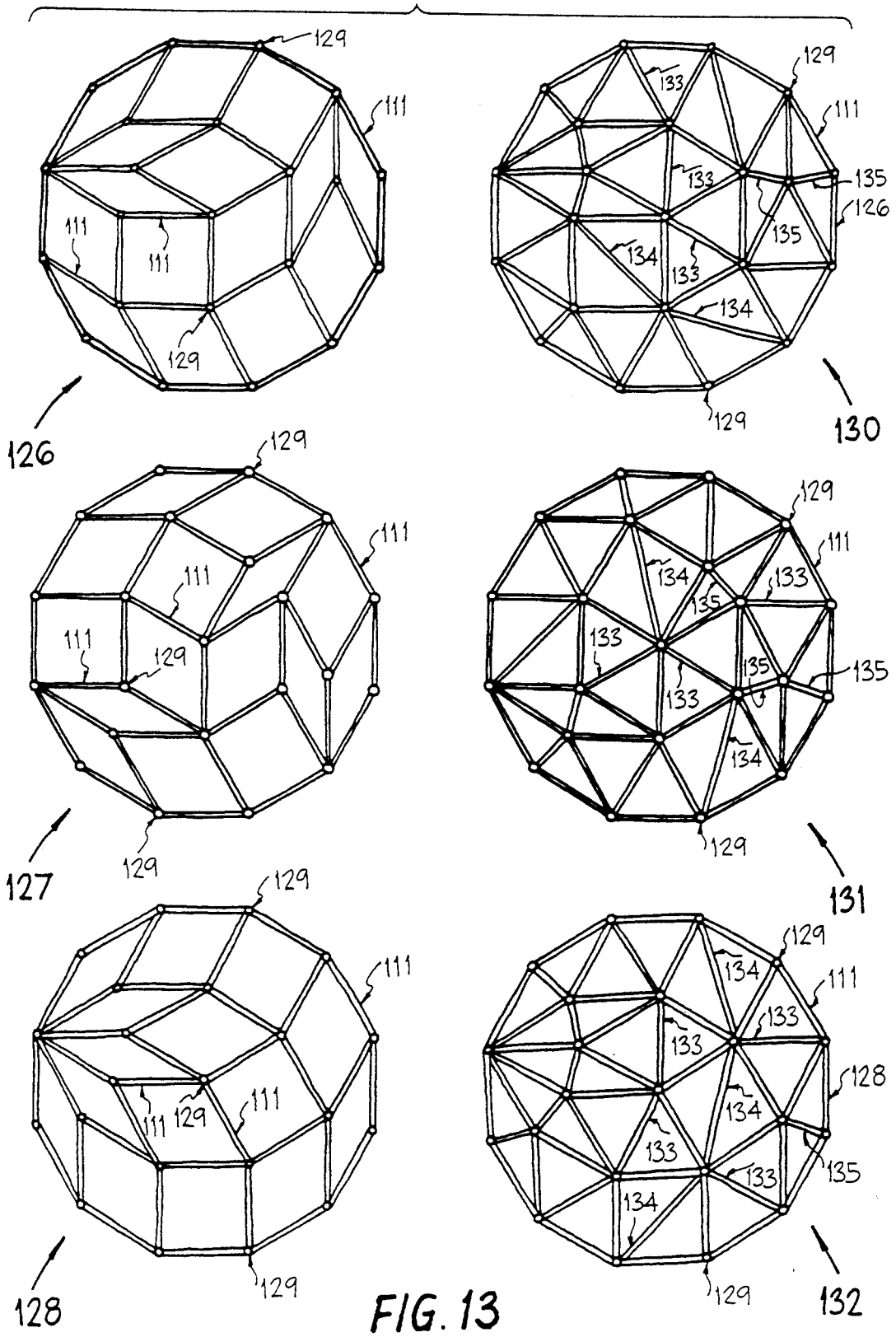

FIG. 13 shows triangulations of three different 12-sided polygonal space frame constructed from nodes of p=6 or 12; the corresponding rhombic frames are shown alongside.

Figure 14A:
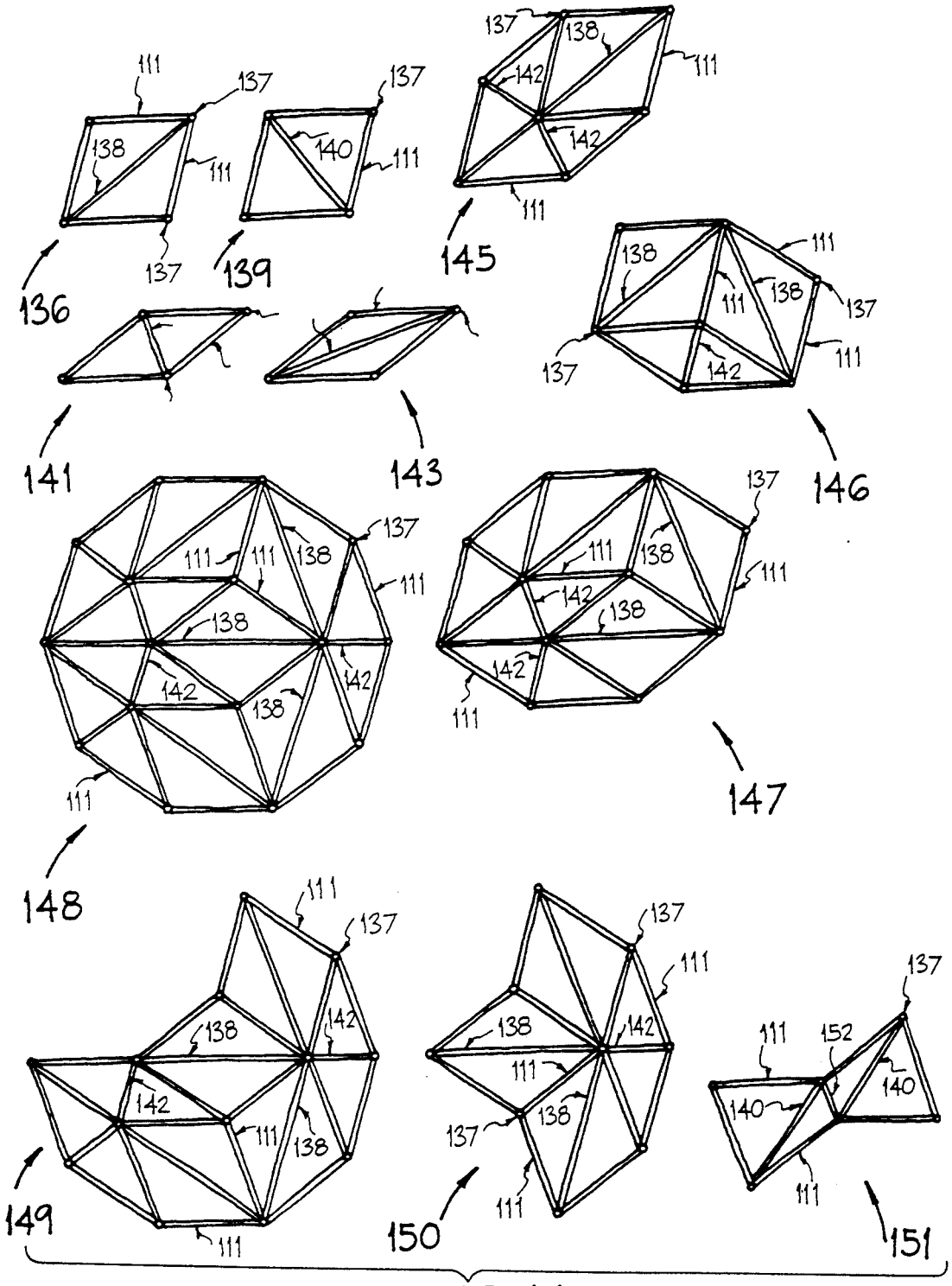

FIG. 14*a* shows triangulation of convex and non-convex even-sided polygonal space frames derived from nodes of p=5 or 10. This method decomposes polygons into rhombii which are then triangulated.

Figure 14B:
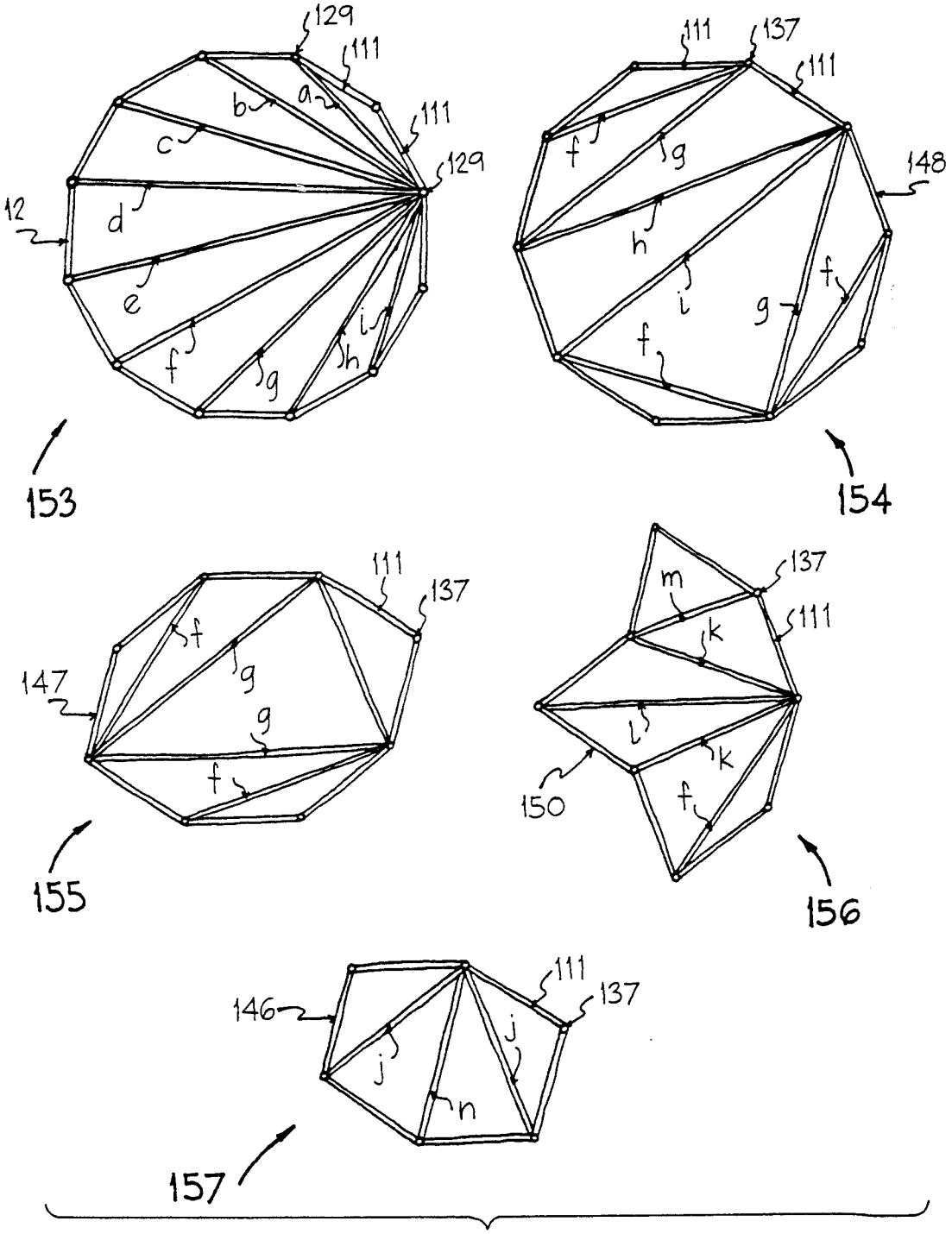

FIG. 14*b* shows an alternative method of triangulation which uses additional diagonals of varying lengths but does not introduce any new vertices within a polygonal area.

Figure 15:
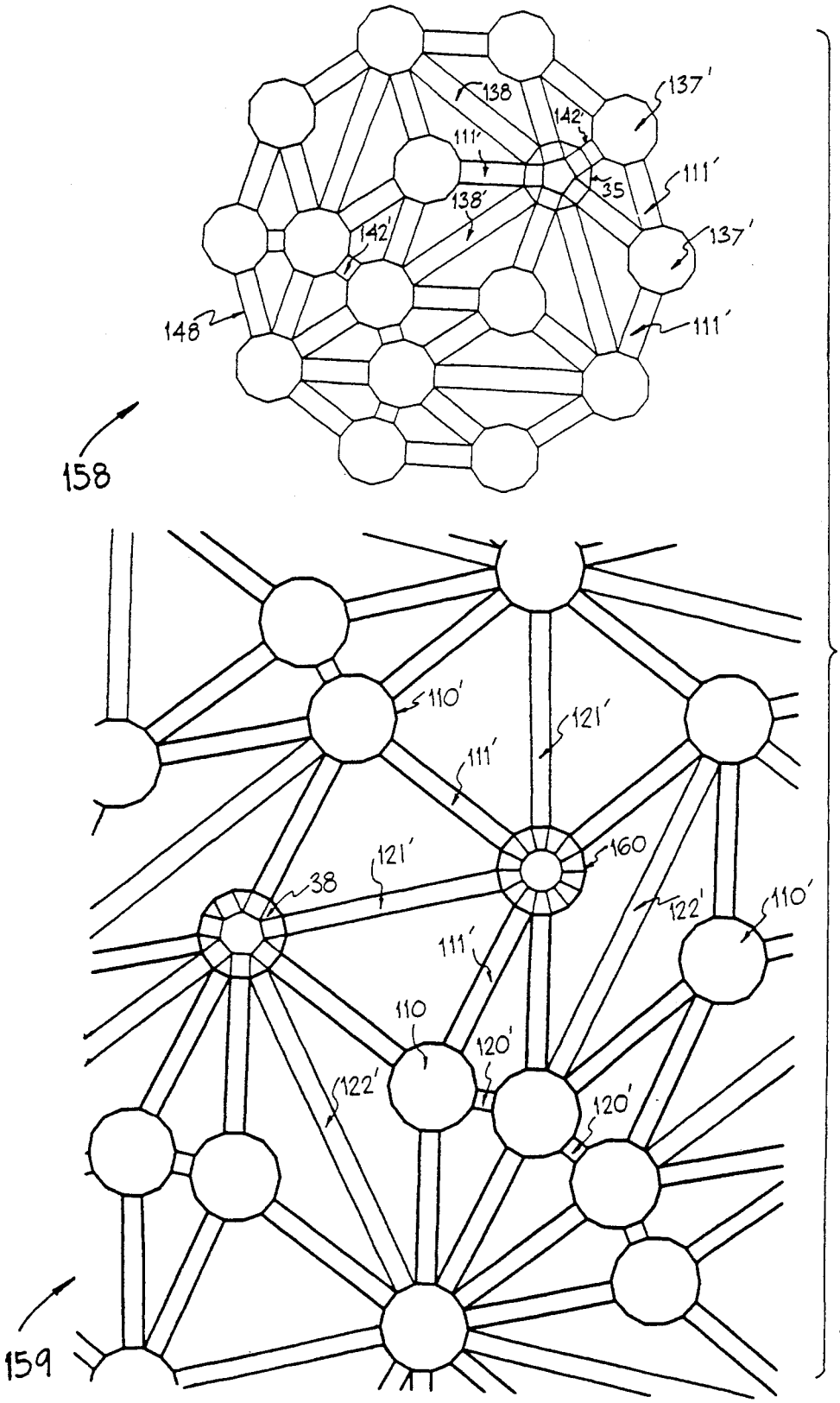

FIG. 15 shows two different triangulated single layers through space frames constructed from nodes of p=5 or 10 (above) and p=7 or 14 (below). The "polygonal" nodes are sections through a prismatic girth of a polyhedron based on the respective prisms.

DETAILED DESCRIPTION OF THE INVENTION

Figure 1A:
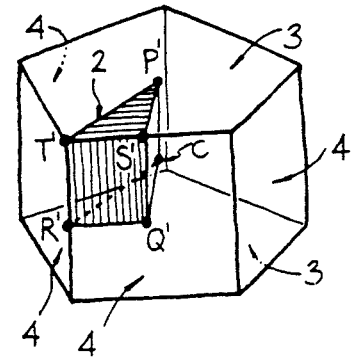

FIG. 1*a* shows a pentagonal prism 1 composed of top and bottom faces which are regular pentagons 3 connected by five upright rectangular faces 4. The shaded region 2 is the fundamental region of the prism. The fundamental region is a right-angled triangular prism with one of its vertices C lying at the center of the prism. The top face P'T'S' is a right-angled triangle with the apex angle at P'=36°. In the general case, this angle equals 180°/p, where p is number of sides of the top or bottom regular polygon of the prism. In a generalized regular prism, P' is located at the center of the top polygon as shown for the pentagon, Q' is at its vertex, S' is at mid-edge of the regular polygon, R' is at the middle of the vertical edge, and Q' is at the center of the upright rectangular or square face.

Figure 1B:
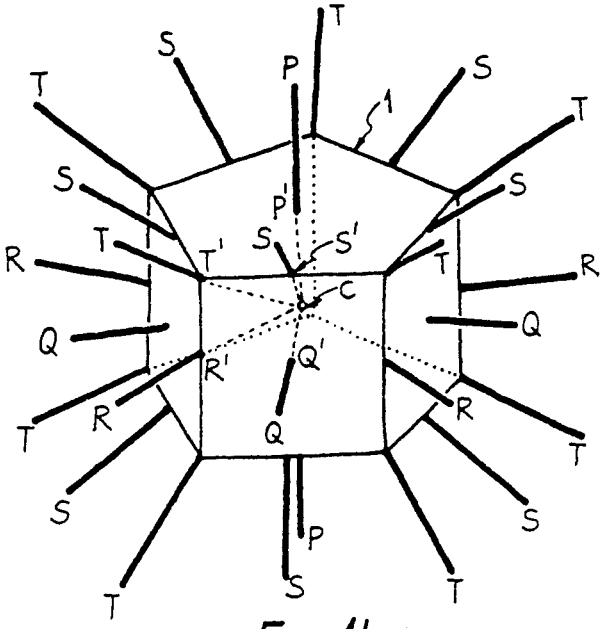

The five set of points, P',Q',R',S' and T', lie on the surface of the prism. These points, when joined to the center of the prism, provide directions for struts as shown in FIG. 1*b*. The radiating axes in FIG. 1*b*, named as P, Q, R, S, and T, correspond exactly to the points P', Q', R', S' and T', respectively, in FIG. 1*a*. Note that the axes P, Q and R are axes of symmetry, where P is the p-fold axis of rotation and both Q and R are 2-fold axes or rotation. S and T are not symmetry axes and correspond to a 1-fold rotation. The regular prism is said to correspond to an infinite class of symmetries p22. In the case of a regular pentagonal prism, the symmetry is 522.

The number of these axes is the same as the number of struts radiating from a node. This number can be derived from the number of vertices, edges and faces of a prism. If V, E and F are the number of vertices, edges and faces of a p-sided prism, the relation between the three is given by the well-known Euler relation V+F=E+2. In the case of a prism, V=2*p* since it is the sum of vertices lying on the top and bottom faces. Also, F=F1+F2, where F1 is the sum of top and bottom p-gonal faces and always equals 2, and F2 is the sum of upright faces and equals p. Thus F=p+2. Further, E=E1+E2, where E1 is the sum of edges lying on the top and bottom faces and equals 2*p*, and E2 is the sum of upright edges and equals p. Thus E=3*p*.

Figure 1C:
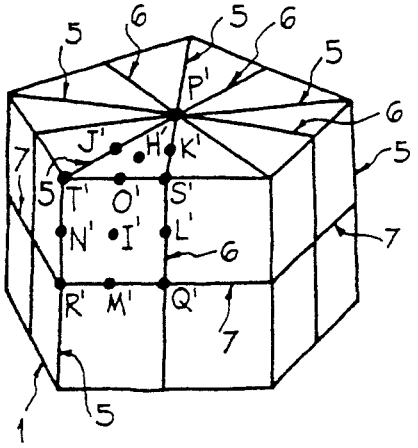

From these relations, and from FIG. 1*b*, it follows that the total number of struts radiating from the center of a prism and corresponding to these five sets of directions equal V+F+E=6*p*+2. The number of P-struts=F1=2, the number of Q-struts=F2=p, the number of R-struts=E2=p, the number of S-struts=E1=2*p* and the number of T-struts=2V=2*p*. In the case of the pentagonal prism, p=5; the total number of struts radiating from a 5-sided prismatic node as shown in FIG. 1*b* equals 32. Additional strut directions can be obtained by adding additional points on the fundamental region as shown in FIG. 1*c*. The J', K', L'M', N' and O' lie on the edges of the fundamental region, and the points H' and I' lie on the outer faces of the fundamental region. Note that the circumscribed lines on the surface of the prism correspond to the mirror planes: a vertical plane 5 through P'T'R', another vertical plane through 6 P'S'Q' and a horizontal mirror plane 7 through R'Q'.

Figure 1D:
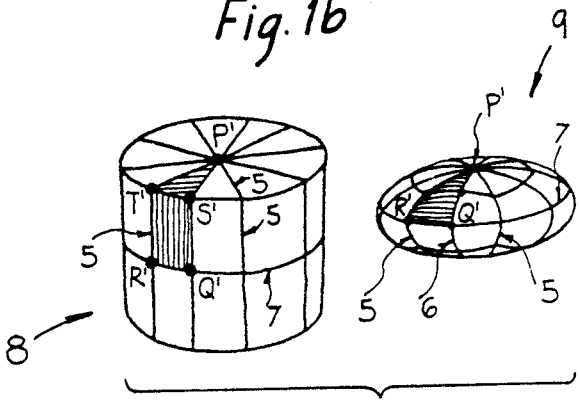
Figure 1E:
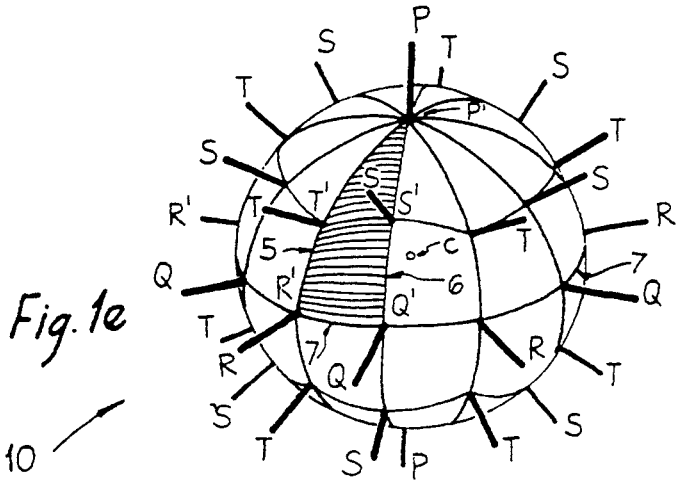

The prism can be projected onto a variety of surfaces like a cylinder 8 or an ellipsoid 9 as shown in FIG. 1*d*, a sphere 10 as shown in FIG. 1*e*, a hyperboloid, or any other quadric or super-quadric surface of revolution. In each instance, the symmetry of the surface or the "solid" remains unchanged as p22, though the shape changes. In the examples shown, one fundamental region is shown shaded in each case, as in FIG. 1*a*. The planes of symmetry, i.e. mirror planes 5, 6 and 7, correspond in FIGS. 1*c*–*e*. The thirty-two radiating axes in FIG. 1*e* correspond exactly to FIG. 1*b*.

FIGS. 2–6 show the derivation of a variety of node shapes based on FIG. 1. Each node retains the symmetry p22 but is derived by a different geometric transformation.

Figure 2:
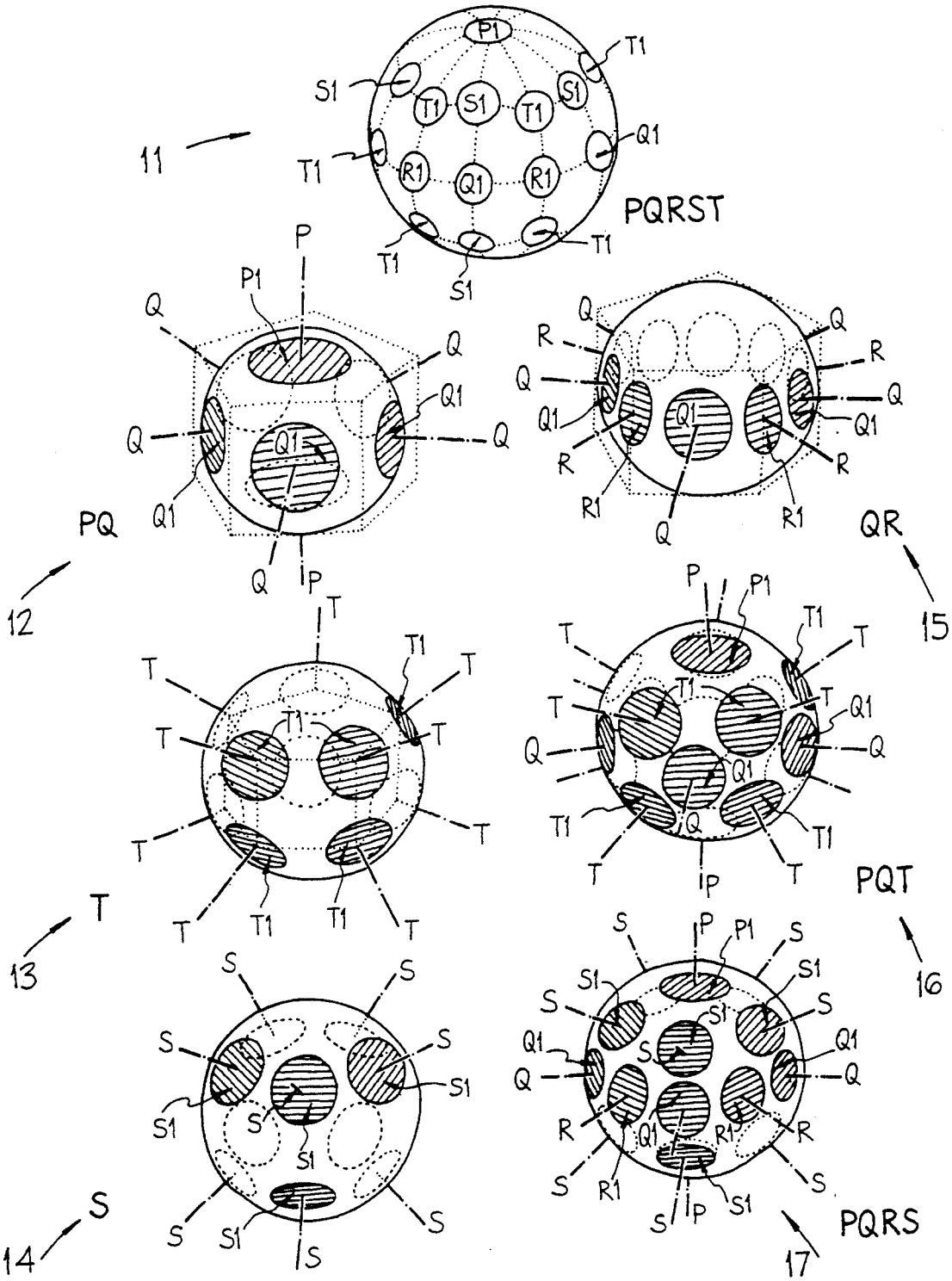

In FIG. 2, seven different spherical nodes of symmetry 522 (p=5) are shown. Each node corresponds to a different combination of axes from the set of five axes P, Q, R, S and T. There are a total of 32 combinations of axes of strut directions which can lead to valid nodes of prismatic symmetry p22. In the seven cases shown, the circles are planes perpendicular to the radial axes. In each case the circle represents a face plane on the node. Details of the geometry of these seven examples are described next. The different ways in which the face plane can be converted into a physical node design which can be coupled with a strut will be described later.

The sphere 11 is the combination PQRST and corresponds exactly to the sphere 10 of FIG. 1. The circles are named accordingly, P1 is perpendicular to the P-axis, Q1 is perpendicular to the Q-axis, R1 to the R-axis, S1 to the S-axis and T1 to the T-axis. This node has 32 circles on the sphere.

The sphere 12 is the combination PQ and has 7 circles. Circles P1 correspond to the two P-axes and the circles Q1 correspond to the five Q-axes.

The sphere 13 is based on the ten T-axes and has ten T1 circles.

The sphere 14 has the ten S-axes and is composed of ten S1 circles.

Sphere 15 is the combination QR with ten circles arranged equitorially and composed of five Q1 and five R1 circles. This particular node can only produce single-layer space frames as in lattice screens.

Sphere 16 is the combination PQT, composed of two P1, five Q1 and ten T1 circles, making a total of 17 circles, and Sphere 17 is the combination PQRS, composed of two P1, five Q1, five R1 and ten S1 circles, making a total of 22 circles.

Figure 3:
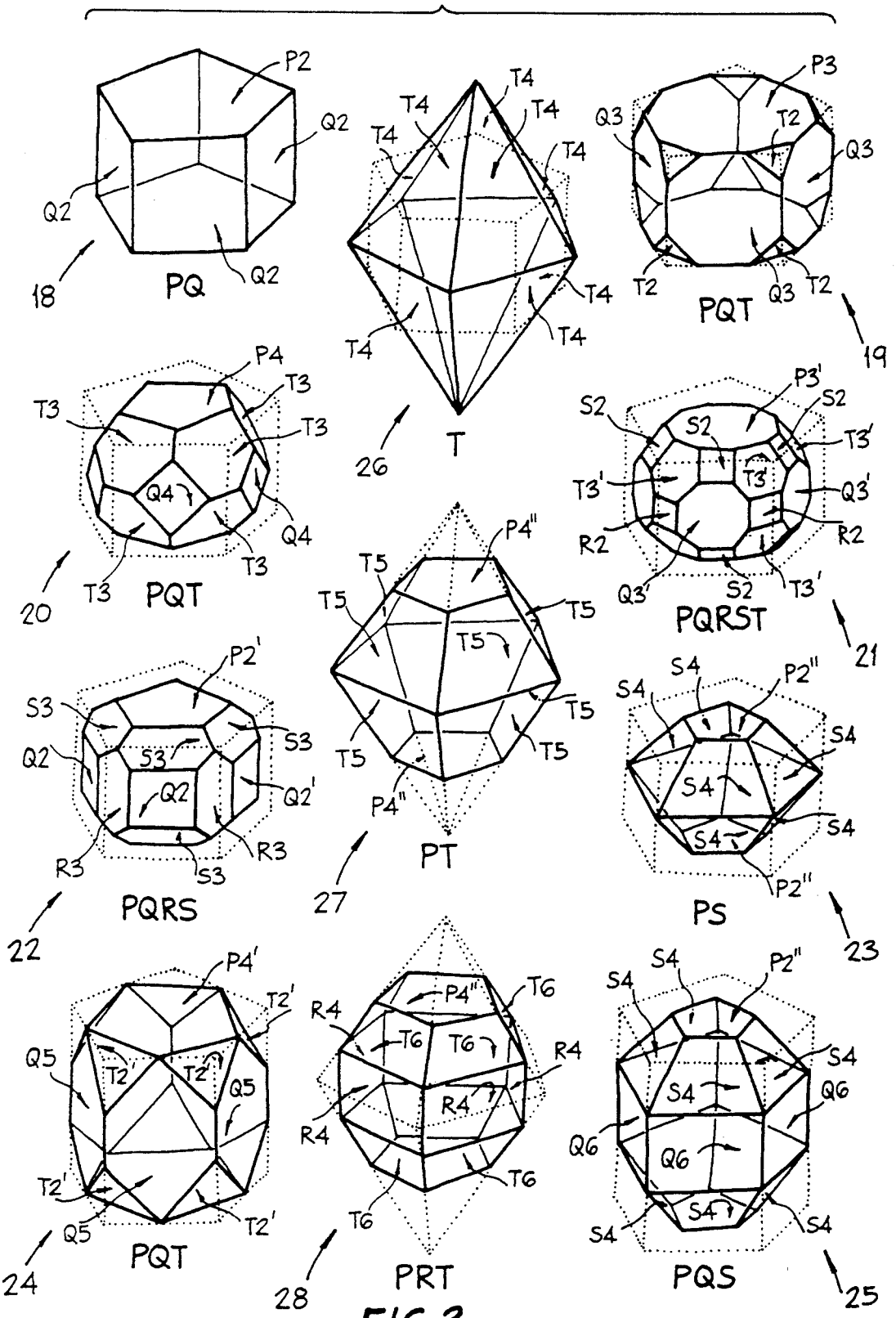

FIG. 3 shows eleven different polyhedra of symmetry 522 (p=5 case). All can be derived from the pentagonal prism 18 by various transformations. This is described next.

The pentagonal prism 18 is composed of top and bottom faces P2 which are perpendicular to the P-axis, and the side faces Q2 are perpendicular to the Q-axis. The prism thus corresponds to the axis combination PQ and is thus similar to the sphere 12.

The polyhedron 19 is obtained from 18 by truncating the ten (or $2p$) vertices producing ten (or $2p$) new triangular faces T2 perpendicular to the T-axis. The top and bottom polygons become 10-sided ($2p$-sided) polygons P3, the upright rectangular or square faces become octagons Q3. The total number of faces equal $3p+2=17$. When this node is used in a space frame, the struts can be coupled to some or all 17 faces. The strut shapes could be polygonal prisms. Since this node has faces perpendicular to P, Q and T axes, it corresponds to the combination PQT and is similar to the sphere The polyhedron 20 also corresponds to the 3-axis combination PQT, and is thus a variation on 19. The top and bottom faces are pentagons P4, corresponding to the P-axis, the hexagonal faces T3 correspond to the T-axis, and the square or rhombic faces Q4 correspond to the Q-axis. This polyhedron also has 17 faces.

The polyhedron 21 corresponds to the 5-axis combination PQRST and has faces corresponding to all five axes. It has a total o thirty-two faces. The top and bottom faces are decagons P3′ corresponding to the P-axis. The ten hexagonal faces T3′ correspond to the T-axis, the five octagonal faces Q3′ correspond to the Q-axis, the ten square or rectangular faces S2 correspond to the S-axis, and the five square or rectangular faces R2 correspond to the R-axis. Note that faces P3′, Q3′ and T3′ are similar to the faces P3, Q3 and T3 in earlier polyhedra but have a different size or proportion of sides. This polyhedron corresponds to the sphere 11 shown earlier.

The polyhedron 22 corresponds to the 4-axis combination PQRS and is composed of twenty-two faces. The two faces P2′ are the top and bottom pentagonal faces which correspond to the P-axis, the five square or rectangular faces Q2′ corespond to the Q-axis, the ten hexagonal faces S3 correspond to the S-axis, and the five vertical hexagonal faces R3 correspond to the R-axis. This polyhedron also corresponds to the sphere 17 shown earlier.

The polyhedron 23 corresponds to the 2-axis combination PS. It has top and bottom pentagonal faces P2″ corresponding to the P-axis and ten trapezoidal faces S4 inclined at an angle to the S-axis.

The polyhedron 24 corresponds to the 3-axis combination PQT, and has seventeen faces like the polyhedra 19 and 20. The top and bottom pentagonal faces P4′ correspond to the P-axis, the ten triangular faces T2′ corespond to the T-axis, and the five hexagonal faces Q5 corespond to the Q-axis. Note that this polyhedron is derived by a special vertex truncation of an elongated pentagonal prism. It corresponds to the sphere 16 which also has seventeen strut directions. Alternatively, the sphere 16 can also be elongated along the P-axis into an ellipsoid.

The polyhedron 25 corresponds to a different 3-axis combination PQS, though it also has seventeen faces. It can be derived from polyhedron 23 by an elongation along the P-axis such that the "top half" of 23 is separated from the "bottom half" and five rectangular faces Q6 are inserted. The remaining faces of 25 remain the same as in polyhedron 23. The faces S4 are also inclined at an angle to the S-axis.

The polyhedron 26 is a pentagonal bipyramid and is the dual of the prism 18. It is composed of ten triangular faces T4, each face corresponding to the T-axis and also to the vertex of the prism. The dual thus corresponds to the axis combination T and is similar to the sphere 13.

The polyhedron 27 corresponds to the 2-axis combination PT and is composed of 12 faces. It can be obtained from the dual polyhedron 26 by truncating the top and bottom vertices to obtain faces P4″. The faces T5 are trapezoids and are also truncations of the triangular faces T4 of the polyhedron 26. Note that this polyhedron is similar to the polyhedron 23 but is turned through an angle of 36°.

The polyhedron 28 corresponds to a different 3-axis combination PRT and is composed of seventeen faces. It can be obtained from the polyhedron 27 by an elongation along the P-axis in a manner similar to the derivation of the polyhedron 25 from 23. Five new faces R4 are inserted to separate the top and bottom halves of the polyhedron 27. The faces R4 are perpendicular to the R-axes. The polyhedron 28 is similar to the polyhedron 25 but is also turned through 36°.

Figure 4:
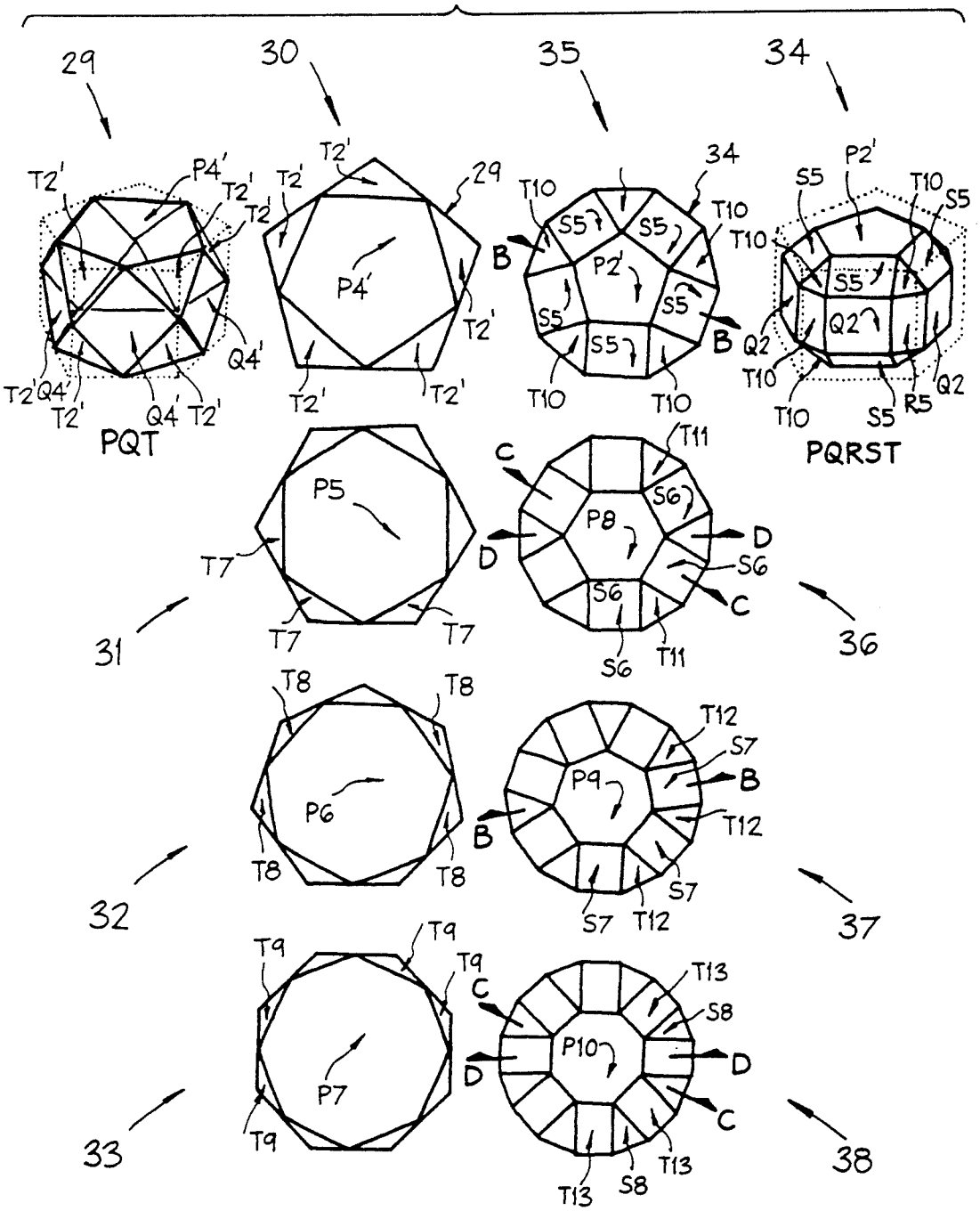
FIG. 4 shows plan views for two classes of polyhedra for prismatic symmetry p22 derived by truncations of a p-sided prism. Examples are shown for p=5, 6, 7 and 8 cases.

FIG. 4 shows two additional examples of polyhedra with symmetry 522, along with their counterparts with symmetries 622 (p=6), 722 (p=7) and 822 (p=8), based on 6-sided, 7-sided and 8-sided prisms.

The polyhedron 29 coresponds to the 3-axis combination PQT and can be obtained from the polyhedron 24 by a shrinkage along the P-axis. The pentagonal faces P4′ and the triangular faces T2′ remain the same in the two cases, and the hexagonal faces shrink to become square or rhombic faces Q4′. The polyhedron 29 also has seventeen faces. Its plan view 30 is shown alongside. The plan view 31 shows the same vertex-truncated polyhedra for the p=6 case obtained from a 6-sided prism. The plan view 32 is the p=7 case from a 7-sided prism, and the plan view 33 is the p=8 case from an 8-sided prism. The top and bottom faces change from 5-sided to 6-, 7- and 8-sided regular polygons identified as P5, P6 and P7, respectively. The triangular faces also change to T7, T8 and T9, respectively, and correspond to the T-axes in each case.

The polyhedron 34 corresponds to the 5-axis combination PQRST and is an alternative to the polyhedron 21. As in the previous case, this polyhedron has the same 32 strut directions as in sphere 11. The polyhedron 34 is composed of top and bottom pentagonal faces P2′ perpendicular to the P-axis, five rectangles or squares Q2 perpendicular to the Q-axis, five squares or rectangles S5 perpendicular to the S-axis and ten triangles T10 perpendicular to the T-axis. The triangles T10 are similar in shape to the faces T4 of the dual 26. The plan view 35 shows the 10-sided equitorial profile of the polyhedron 34. The plan views 36, 37 and 38 are analogous to 35 and correspond to p=6,7 and 8 cases, respectively, and are polyhedra obtained from 6-, 7- and 8-sided prisms. Faces P8, P9 and P10 are regular polygons with 6, 7 and 8 sides and are perpendicular to the P-axis. Faces T11, T12 and T13 are perpendicular to the T-axes, and faces S6, S7 and S8 are perpendicular to the S-axes of the respective prisms.

Figure 5:
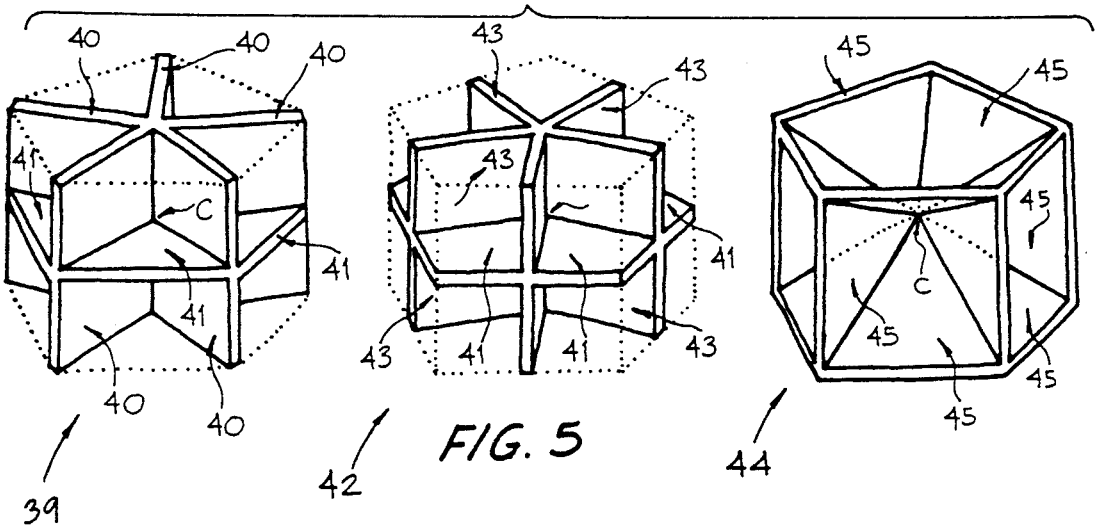
FIG. 5 shows configurations of radial planes for node shapes based on prismatic symmetry 522.

FIG. 5 shows three examples of concepts for node shapes composed of radial planes derived from the pentagonal prism 1 shown earlier in FIG. 1*c*. Here each radial plane has an apropriate thickness and can receive an appropriately shaped strut to which it can be appropriately coupled, as will be shown with an example later. In the node 39, the mid-plane element 41 corresponds to the horizontal mirror plane 7 of FIG. 1*c*. Similarly the vertical elements 40 correspond to the mirror planes 5 in FIG. 1*c*. In the node 42, the element 43 corresponds to the mirror plane 6 in FIG. 1*c*, and the element 41 is the same as in node 39. The node 44 is composed of radial planes obtained by joining the edges of the prism to the center C. Additional noe shapes can be obtained by combining the radial planes 40, 41, 43 and 45 in any combination. Similar radial nodes can be derived for p=6, 7, 8, . . . Further, corresponding radial nodes can be derived from the sphere 10 in FIG. 1*e*, or the cylinder 8 and the ellipsoid 9 in FIG. 1*d*.

Figure 6:
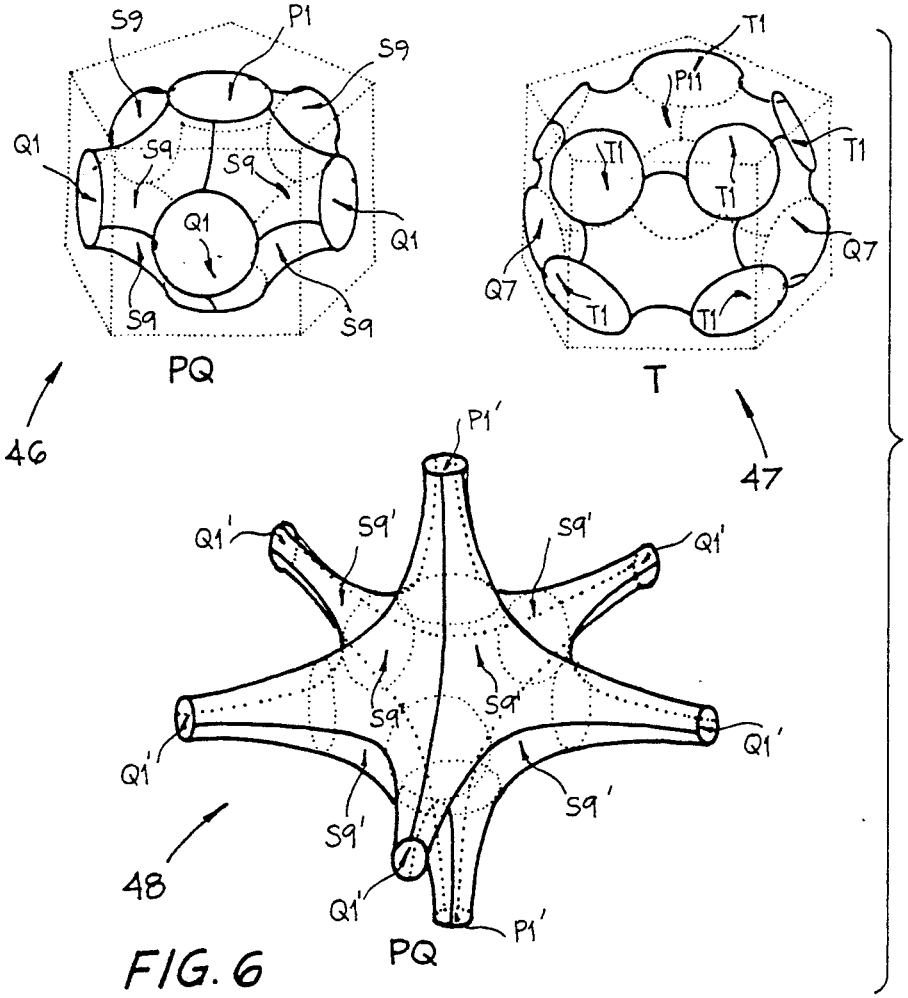
FIG. 6 shows saddle polyhedra as possible node shapes of prismatic symmetry 522.

FIG. 6 shows three saddle polyhedra for the p=5 case of prismatic symmetry. In each case, the saddle polyhedra are composed of flat faces perpendicular to any axis, and saddle polygons. The flat faces are shown as circles, and could be converted into ellipses or superellipses. The curved edges of the saddle polygons are composed of arcs od circles. Alternatively, polygons with straight or partially curved edges could be used.

The saddle polyhedron 46 is composed of top and bottom circular faces P1 perpendicular to the P-axis, and five (or p) circular faces Q1 perpendicular to the Q-axes. These provide seven (or p+2) strut directions, as in the case of the sphere 11; thus 46 coresponds to the 2-axis combination PQ. In addition, this node has ten (or 2*p*) saddle hexagons S9 which are perpendicular to the S-axes.

Saddle polyhedron 47 is composed of ten (or 2*p*) circular faces T1 perpendicular to the T-axis, providing ten strut directions similar to the sphere 13. It corresponds to the the 1-axis combination T. In addition, the polyhedron has top and bottom saddle decagonal (or 2*p*-gonal) faces P11 perpendicular to the P-axis, and five saddle octagonal faces Q7 perpendicular o the Q-axes.

The saddle polyhedron 48 is a 2-axis combination PQ, and is similar to the saddle polyhedron 46. All the faces in the two correspond and are designated accordingly, i.e. P1′ corresponds to P1, Q1′ to Q1, and S9′ to S9. The node and saddles are elongated in 48.

Figure 7:
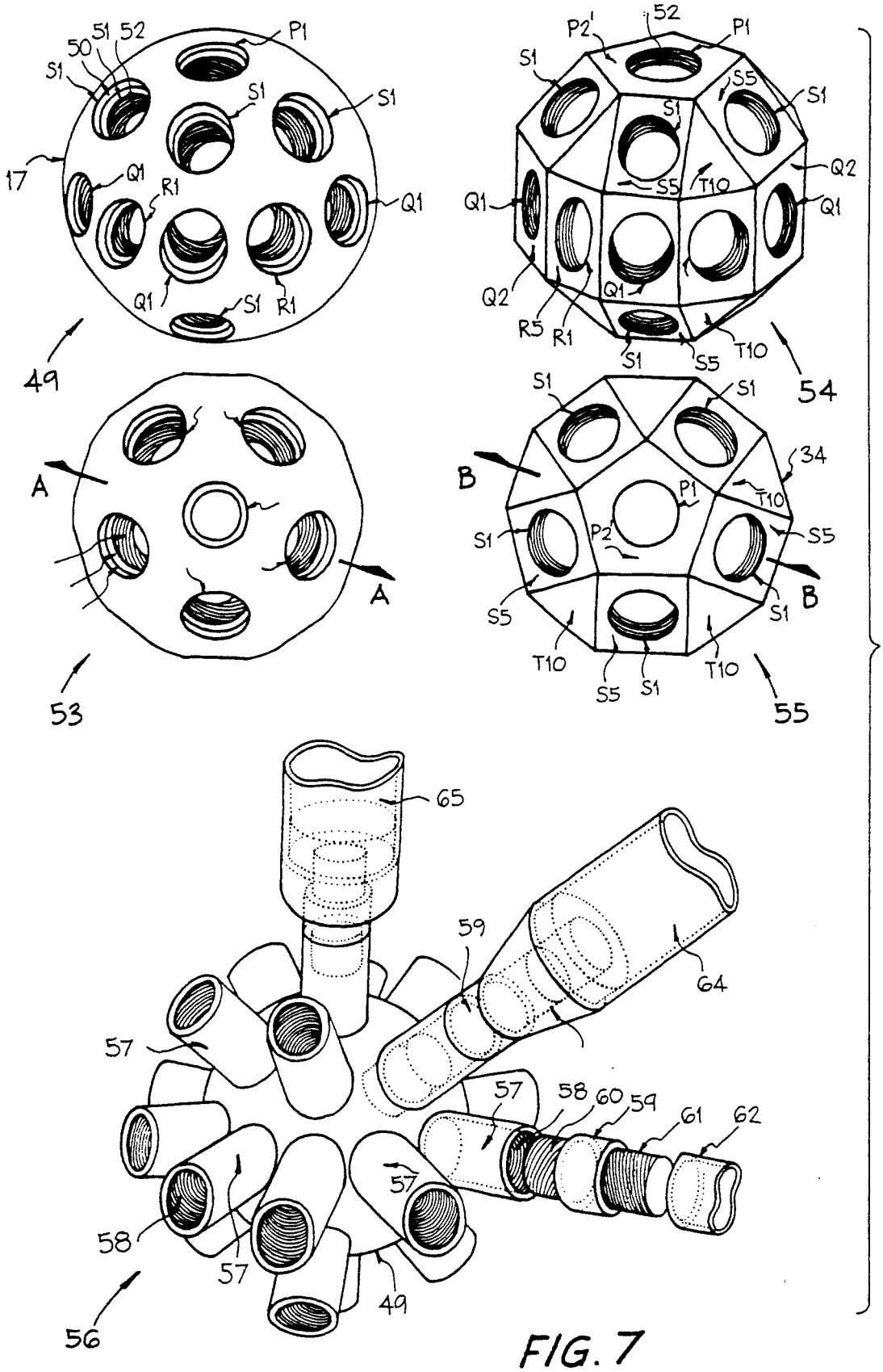
FIG. 7 shows two nodes for space frames derived from a pentagonal prism. The spherical node is based on FIG. 2, and the polyhedral node is based on FIG. 4.

FIG. 7 shows details of two node shapes for p=5 case and based on the 4-axis combination PQRS. The spherical node 49 corresponds to the sphere 17 shown earlier, and is also shown in its plan view 53. The node has twenty-two holes to receive a maximum of twenty-two struts. Of these, two holes are along the P-axes, ten along the S-axes, and five each along the Q- and R-axes. The face circles of the sphere 17 are converted inot circular holes which are named P1, Q1, R1 and S1, accordingly. Each hole has a recess 50 and a flange 51 to receive the strut or a suitable coupling device for the strut. The threads 52 are shown as one example of coupling by screwing. Alternative couplers which lock by various mechanical actions, by an enlargement after insertion, or by non-mechanical means can be used.

The polyhedral node 54, based on the polyhedron 34, is an alternative shape for the twenty-two strut directions. It is based on the same PQRS combination as in the spherical node 49. Here the recessed flange is replaced by a threaded surface 52. Note that the ten triangular faces T10 are not used in this node, though these can provide additional ten (or 2*p*) struts along the T-axes. The plan view 55 corresponds to the earlier plan view 35, and can be similarly extended to p=6,7,8 and higher values of p as shown in earlier plan views 36–38.

Various coupling devices can be used by suitably designing the mating ends of the nodes and the struts. Both node and strut ends could be either male or female, permitting four combinations: male node end with female or male strut end, or a female node end with male or female strut end. Male ends on nodes could be separate coupler pieces which themselves could have male or female ends.

The illustration 56 shows the coupling device for connecting the spherical node 49 with three alternative strut shapes 62, 64 and 65. All three use a coupler 57 which screws into the threaded holes in the node on one side, and receives the turn-buckle screw 59 on the other side. The handedness of the threads 60 on one-side of 59 matches the threads 58 on the interior of the coupler 57. The reverse-handedness of the threads 61 on the other half of the turn-buckle 59 match the threads on the interior of the strut 62 and 65. It also matches the threads on the interior of the end-piece 63 which is coupled to the strut 64. The end-piece can be screwed into the strut prior to the coupling with the turn-buckle which is one way of providing a fine-tuning of the distance between the node-centers (i.e. strut length). Alternatively, in some cases the turnbuckle 59 could be screwed directly into the node eliminating the use of the coupler 57.

Figure 8:
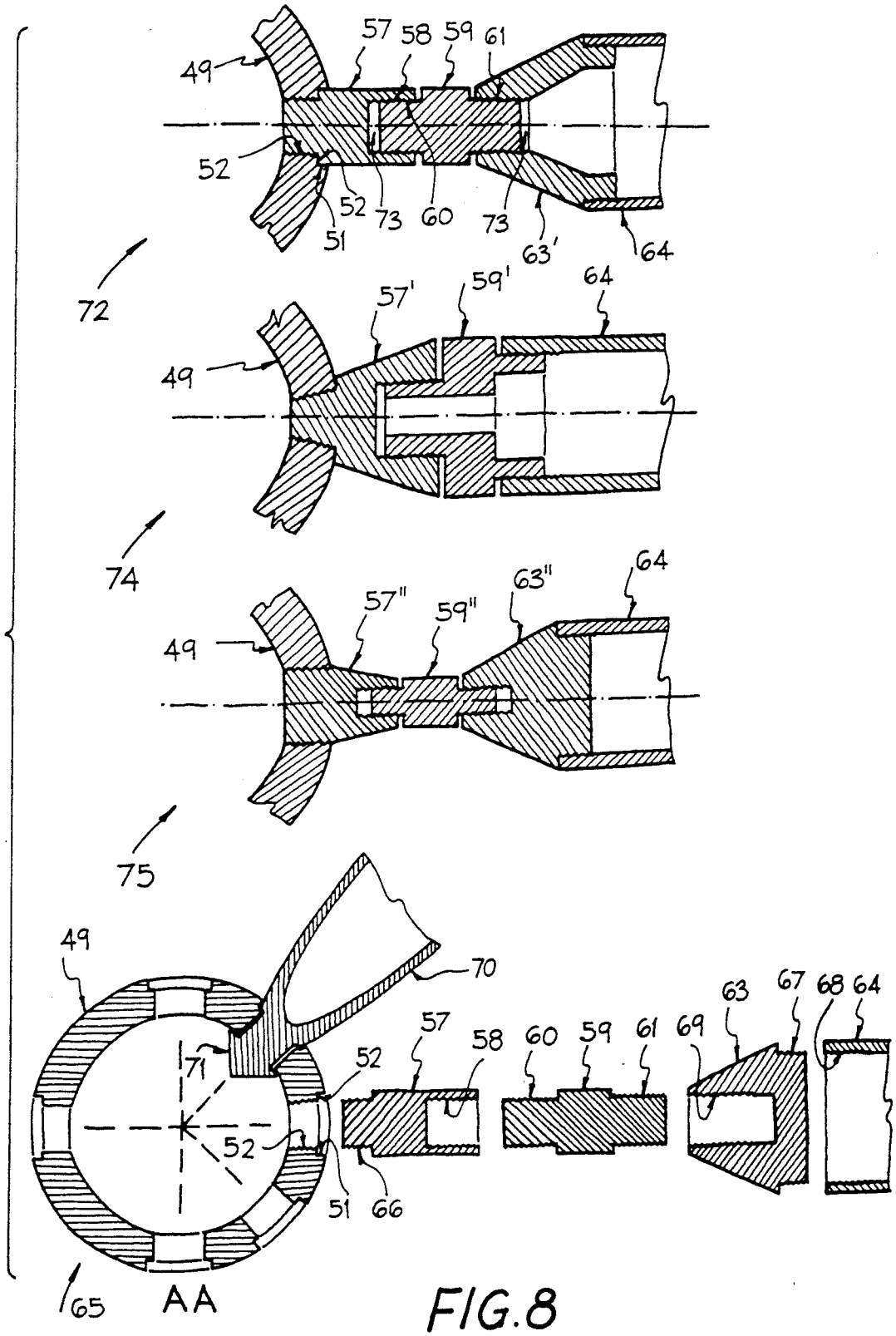
FIG. 8 shows sections through four different coupling devices for connecting a strut to a node.

FIG. 8 clarifies details of the section 65. This is the section AA shown in the plan view 53. The node 49 is shown as a hollow sphere and the wall thickness could be varied as needed for strength and attachment. In some cases, as in small-scale structures or model-kits, a solid sphere may be more desirable. The coupling mechanism between the node and the strut is shown separated in the illustration. The coupler piece 57 has a threaded male end 66 which screws into the threaded hole 52 of the node. The strut end-piece 63 is screwed into the strut 64 such that the threaded surfaces 67 and 68 match. The strut, with the end-piece attached, can now be coupled to the node, which also has the coupler piece 57 attached, through an intermediary turn-buckle piece 59. The end 60 of the turn-buckle 59 screws into the female end 58 of the node coupler, and the other end 61 screws into the female end 69 of the strut end-piece. Strut 70 is an alternative one-piece strut with a compressible (deformable) head 71 and can be inserted into the node with a slight force. Such a device may be more suitable for model-kits. The head 71 could be suitably shaped as a sphere or a cone, or any other shape that facilitates insertion. In some cases friction joints may be acceptable.

The section 72 shows a coupling mechanism in an engaged position and is similar to the section 65 with the only difference that the strut end-piece 63' is a slight variant of 63. The gaps 73 will vary as the turn-buckle is adjusted. The sections 74 and 75 are variants of 72, where 57' and 57" are variants of the cylindrical coupler 57, 59' and 59" are variants of the turn-buckle 59, and 63" is a variant of 63. Note that in 74 the end-piece for the strut is eliminated.

Figure 9:
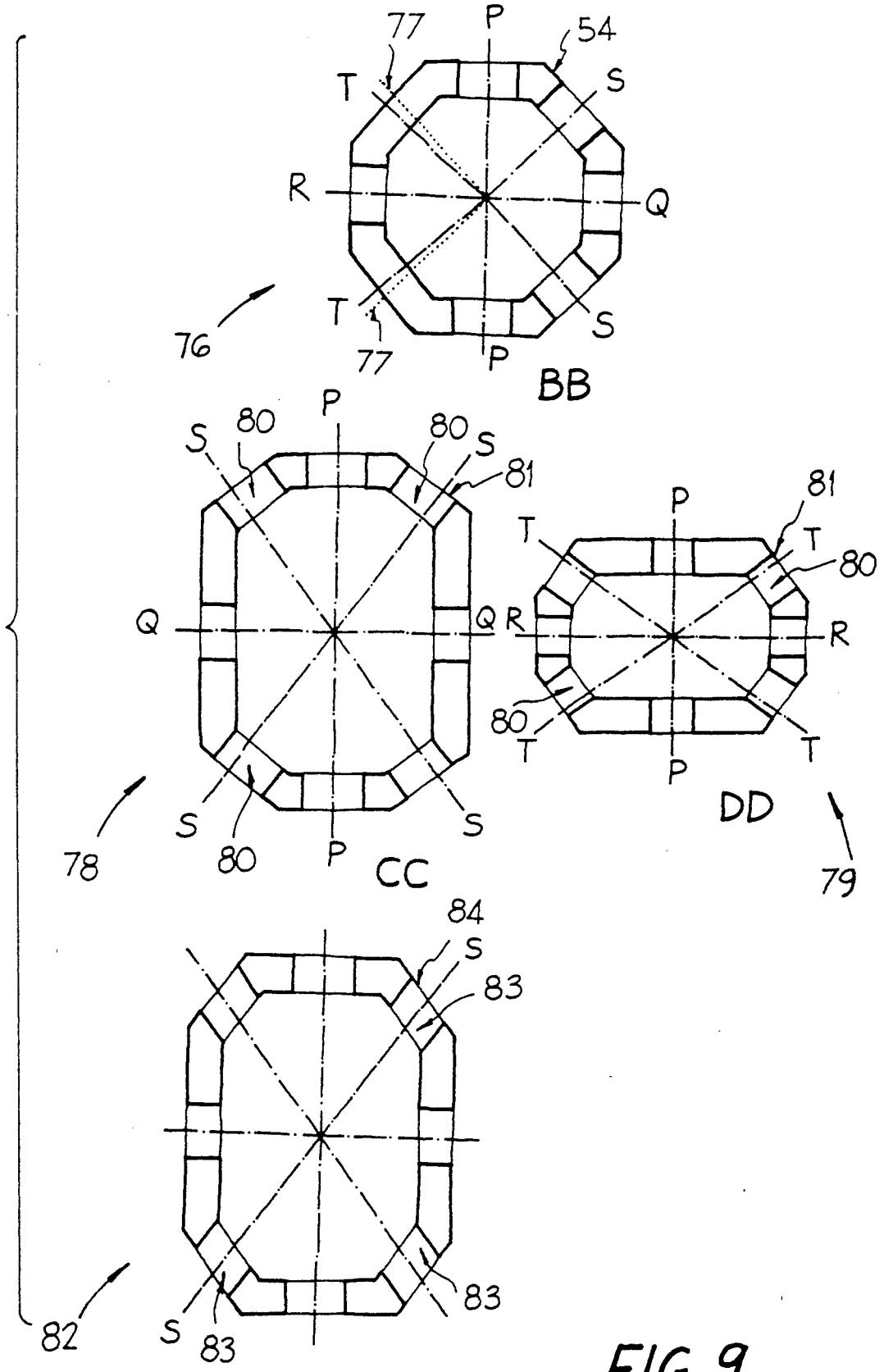
FIG. 9 shows sections through polyhedral nodes obtained from prism of varying heights.

FIG. 9 shows various sections through hollow polyhedral nodes based on the polyhedral 35–38 shown earlier in FIG. 4. Section 76 is the section BB through the node 54 (see plan view 55 in FIG. 7) which is based on the polyhedron 35. The axes P, Q, R, S and T are marked. Note that in this section the axes S and T are not collinear and the deviation is shown by the dotted line 77. This asymmetry is characteristic of a vertical section through any odd-sided prism, i.e. for all odd values of p. (For example, see the polyhedron 37 for p=7 case in FIG. 4). In the case of nodes based on even values of p, two different sections CC and DD are possible. These are shown as 78 and 79 and correspond to sections through polyhedra 36 and 38 in FIG. 4 for the p=6 and p=8 cases, respectively. Note that the sections are symmetrical though both axes, S in 78 and T in 79, are eccentric with respect to the holes 80 through which they pass. The two sections are shown for polyhedra of different height.

The eccentricity can be corrected as shown in 82. The planes 81 are tilted at an appropriate angle to the plane 84. In so doing, the holes 83 become skewed with respect to the axes S which now pass through the center of the holes. The strut is no longer perpendicular to the faces of the node, though is still aligned to the center of the node. Sections 78, 79, and 82 can also be sections through nodes based on any solids of revolution around the axis P.

Figure 10:
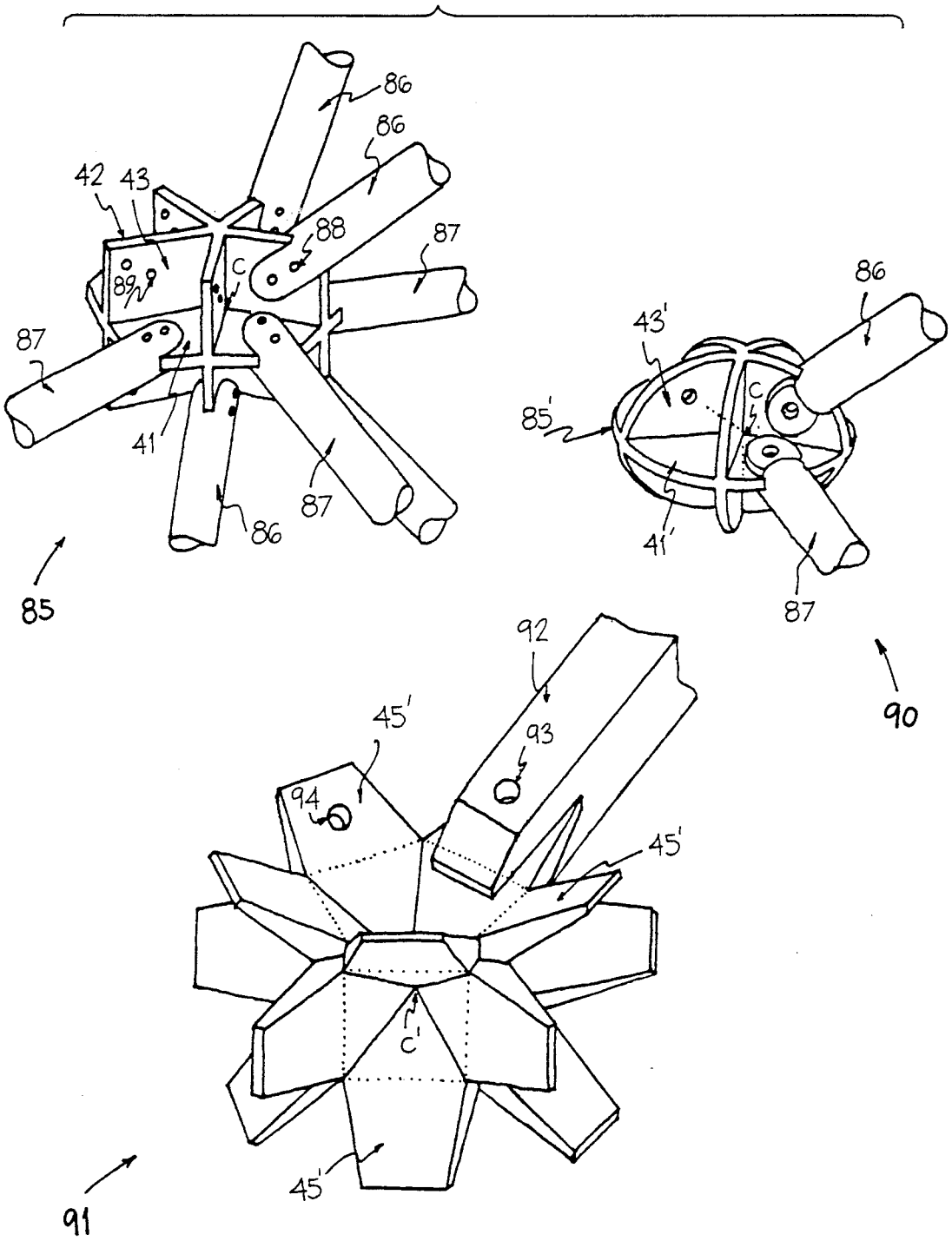
FIG. 10 shows three different node shapes of prismatic symmetry 522 based on radial planes.
Figure 11:
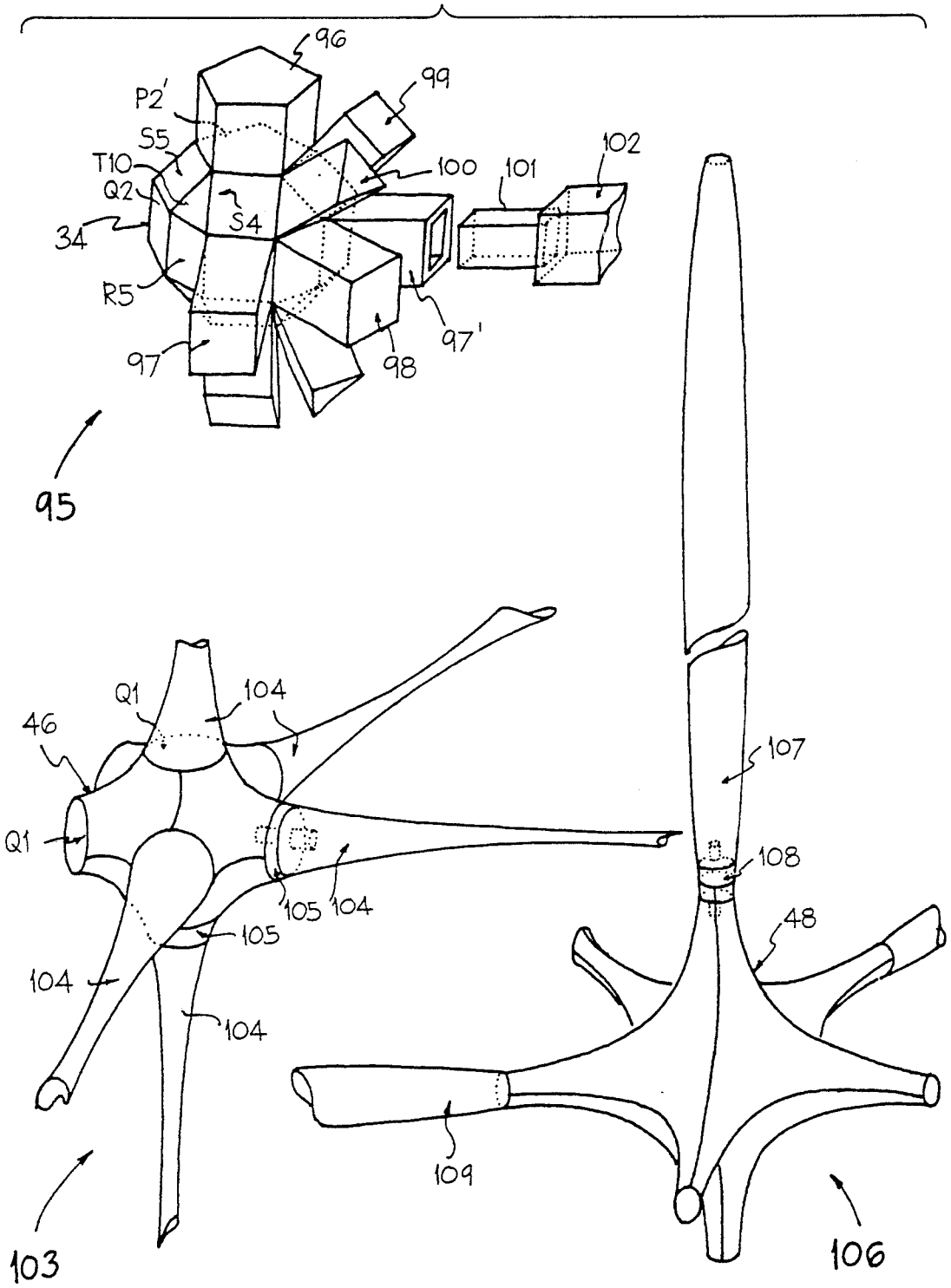
FIG. 11 shows three additional alternatives based on nodes derived from a 5-sided prism. A star-like node based on a plane-faced polyhedron using prismatic and anti-prismatic struts (not shown), and saddle nodes with struts based on inflated and deflated cylinders.

FIGS. 10 and 11 shows six different examples of node shapes coupled with various strut shapes based on earlier concepts shown for the p=5 case. In FIG. 10, the node-strut assemblage 85 uses the radial plane arrangement 42 shown earlier in FIG. 5. The strut directions correspond to the 2-axis combination RS, with ten struts 86 along the S-axis and five struts 87 along the R-axis (only a few struts are shown). In the example shown, the struts have a cylindrical cross-section and hemispherical ends. The radial planar elements 42 and 43 of the node receive the strut ends which are "split" to go around the elements 42 and 43. The holes 88 in the struts are aligned to the holes 89 in the node and suitable pins or screws are inserted. Various other mechanical coupling devices can be used alternatively.

The node 90 is a variant of the node 85 and has curved radial planes, the overall node shape can be an oblate ellipsoid as shown, a sphere or an elongated ellipsoid. The ends of the struts can be planar discs as shown.

The node 91 is based on the radial node geometry 44 shown earlier in FIG. 5. The radial planes 45 are here modified to 45' by extending and tapering these planes (both in plan and elevation). One possible strut 92, rectangular in cross-section, is connected by pins which align the holes 93 in the strut with the holes 94 in the node.

In FIG. 11, the node 95 is based on the polyhedron 34 shown earlier in FIG. 4 (the polyhedron 34 can be partially seen on the left side in the illustration). The faces of the base polyhedron can be extended into corresponding prism-shaped protrusions as shown. For example, 96 is a protrusion of the pentagonal face P2', 97 is a protrusion of the face Q2, 98 corresponds to the face R5, 99 to the face S5, and 100 to the face T10. This way, when all faces are extended in the manner shown, the polyhedron resembles a stellar node. The directions of the axes correspond to the 5-axis combination PQRST, as in the case of the polyhedron 34. These protrusions can act as couplers to the struts through various attachment techniques. In one example, the hollow protrusion 97' acts like a female to receive the male end 101 of the strut 102.

The node 103 uses the saddle node 46 of FIG. 6. It receives the struts 102 which are shaped as elongated hyperboloids. The struts are coupled to the faces Q1 of the node through suitable attachment. A variation on the turn-buckle concept of FIG. 8 can be used as one example of attachment. In this example, the elements 105 correspond to the turn-buckle 59 of FIGS. 7 and 8. The node 106 uses the saddle polyhedron 48 of FIG. 6. In the present example, the strut shapes are shown as inflated cylinders 107. Attachment by an element 108 is also a variant of the turn-buckle concept.

The parent application describes multi-layered space frames using prismatic nodes coupled by struts to form even-sided convex or non-convex polygonal areas. These areas are various rhombii, hexagons, octagons, decagons and so on. In pin-jointed space frames, where the struts can rotate around the node when subjected to forces, these polygonal areas need to be triangulated to keep the structure stable. This was illustrated in the parent application in FIGS. 19–24. Here this concept is extended to show various methods of triangulation.

FIG. 12*a* shows related portions of a pin-jointed space frame based on p=7 or 14. The space frame 109, a single-layer space frame, is a regular 14-sided polygon composed of three different types of rhombii. The nodes 110 are shown as spheres, and the struts 111 are equal in length. The space frame is unstable in its own plane. The double-layered space frame 112 is composed of top and bottom horizontal planes 109 inter-connected by vertical struts 113. The vertical polygons are squares or rectangles, and as per the parent application, these polygons could be rhombii or parallelograms. This type of a space frame is unstable in both the vertical and horizontal planes. The space frame 114 is an irregular portion embedded in 112, and has the same problem of stability.

FIG. 12*b* shows various ways of triangulating the single-layer frame 109. In all five cases shown, the arrangement of rhombii is identical to 109, but the rhombii are triangulated differently. In 115, the three rhombii are triangulated by inserting the short diagonal within each rhombs. These short diagonals are marked 119, 120 ind 121. In 116, the long rhombii are used instead and are correspondingly marked 122, 123 and 124. In cases 117 and 118, a combination o long and short diagonals is used. In 125, both long and short diagonal are superimposed within each rhombus and are shown as tension cables, where cable 119' corresponds to the strut 119, 120' to 120, and so on. Similarly, the vertical or inclined polygons in multi-layered space frames can be triangulated using various combinations of diagonals.

FIG. 13 shows the triangulation of space frames using prismatic nodes derived from a different value of p. In this case, the frames are based on nodes 129 derived from p=6 or 12 which are coupled by struts 111. The three examples show single layered structures with an overall convex profile with the difference in the arrangement of the rhombii. Note that here too three different rhombii are used as in the configuration 109, but the face angles of the rhombii are different. The triangulation of the rhombii using diagonals is shown in the space frames 130–132 which correspond to the frames 126–128. In each case, three diagonals 133, 134 and 135 are inserted.

FIG. 14*a* shows the triangulation of various convex and non-convex even-sided polygons in space frames constructed from nodes of p=5 or 10. These nodes are marked 137 and are coupled by struts 111. The rhombus 136 is triangulated by inserting the long diagonal strut 138, or by the short diagonal 140 as shown in 139. Similarly, the rhombus 141 is triangulated by the short diagonal 142, or the long diagonal 144 as shown in 143. Most even-sided convex and non-convex polygons with sides can greater than four can be decomposed into these four types of triangulated rhombii as shown in polygonal frames 145–150. These frames include the hexagons 145 and 146 which is decomposed into three rhombii, the octagon 147 decomposed into six rhombii, the decagon 148 decomposed into ten rhombii, a non-convex decagon 149 composed of seven rhombii, and a non-convex octagon 150 composed of four rhombii. The non-convex hexagon 151 requires an additional strut 152 and cannot be decomposed into rhombii. Note that in all polygonal structures 145–150, the decomposition into rhombii requires the inserting of additional nodes within the polygonal area.

FIG. 14*b* shows an alternative method of triangulation in which no interior vertices are introduced. An s-sided polygon needs (s−3) additional struts to triangulate it completely. In the figures, the additional struts are diagonals of varying lengths obtained by joining any exterior node to any other. In the triangulated frame 153, the 12-sided polygon 126 is triangulated by inserting nide additional diagonals of five different lengths a, b, c, d and e. In the triangulated frame 154, 10-sided decagon is stablized by seven diagonals of four different lengths f, g, h and i inserted in an asymetrical arrangement. In the triangulated frame 155, the octagon 147 is stabilized by inserting five diagonals; in the example illustrated, three lengths f, g and j are shown and are inserted in a symmetrical way. In the triangulated frame 156, the non-convex octagon 150 is stabilized by five additional diagonals; here too an asymmetrical arrangement is shown and is obtained by inserting diagonals of four lengths f, k, l and m. In the triangulated frame 157, the hexagon 146 is stabilized by three additional struts of two different lengths j and n.

FIG. 15 shows top plan views of a triangulated single layer from two different multi-layered space structures. Each is shown with prismatic nodes with a well-defined shape. The configuration 158 (p=10 case) is similar to 148 in FIG. 14*a*. The spherical nodes 137 are here replaced by decagonal prisms 137', and the cylinderical struts 111 are replaced by 111'. The struts 111' define the edges of a rhombii, and the struts 138' and 142' are the diagonal struts corresponding to the earlier 138 and 142, respectively. The node 35 (shown earlier in FIG. 4) is an alternative polyhedral node based on p=10. The configuration 159 has nodes derived from p=14 and compares with earlier configurations in FIG. 12*b*. The earlier spherical nodes 110 are replaced by 14-sided prisms 110', and the struts 111 by 111'. The struts 111' define the edges of rhombii, and the struts 120', 121' and 122' are diagonal struts corresponding to the earlier diagonals 120, 121 and 122. The polyhedral nodes 38 (shown earlier in FIG. 4) and 160 are alternative node shapes for this configuration. The node 160 (p=14) is similar to the node 25 (p=5 case) shown earlier in FIG. 4.

Clearly, more variations based on the invention could be made by those skilled in the art. Within the definition of the prismatic symmetry as set forth, and strut directions specified by regular prisms, a large variety of node shapes can be made as variations on the theme. Only a few have been shown but these are sufficient to illustrate the scope of the invention as defined in the appended claims.

What is claimed is:

1. A space frame building system composed of a plurality of polyhedral nodes interconnected by a plurality of struts of substantially equal lengths and arranged in layered arrays, wherein the said nodes are derived from a regular p-sided prism, termed source prism, having any height and composed of *2p* vertices termed source vertices, *3p* edges termed source edges and p+2 faces termed source faces, wherein said source faces comprise a top and bottom regular p-sided polygonal face joined by p rectangular side faces, said source edges comprise p edges each on said top and bottom faces joined by p edges along said side faces, and said source vertices comprise p vertices each on said top and bottom faces, said nodes having attachment locations on its faces, termed node faces, derived from said source prism, wherein said node faces are perpendicular to or at any angle to the axes of said struts, wherein said axes of said struts are determined by any combination of axes obtained by joining the center of the said source prism to any combination of points on the source prism and selected from the group comprising:

source vertices, mid-points of source faces, mid-points of source edges, or any other positions on the surface of the said source prism, wherein p is any number selected from the group consisting of:

odd number greater than 3 when said arrays are non-periodic, even number greater than 6 when said arrays are non-periodic, odd number greater than 3 when said arrays are periodic, and even number greater than 8 when said arrays are periodic.

2. A building system according to claim 1, wherein the said node faces are obtained by any combination of truncations selected from the group comprising:

truncation of source vertices, truncation of source edges, or truncation of source edges and source vertices, truncation of vertices of the dual of said source prism, truncation of edges of the dual of said source prism, or truncation of edges and vertices of the dual of said source prism.

3. A building system according to claim 2, wherein the said node faces obtained by said truncation of said source vertices are triangles or hexagons.

4. A building system according to claim 2, wherein the said truncation of said source edges are selected from the group comprising:
the p source edges defined by the top p-sided polygon of the said source prism,
the p source edges defined by the bottom p-sided polygon of the said source prism,
the p source edges joining the top and bottom p-sided polygons of said source prism, or
any combination of the said source edges.

5. A building system according to claim 2, wherein the said truncation of said source edges produces new polygonal node faces which are rectangles, trapezoids or hexagons.

6. A building space frame system according to claim 1, wherein
the said nodes comprise various saddle polyhedra of prismatic symmetry, wherein
the said saddle polyhedra are composed of two sets of said node faces comprising flat faces and saddle polygons, and wherein
the said flat faces have straight or curved edges, and
the said struts are coupled to either set of said node faces.

7. A space frame building system composed of a plurality of nodes interconnected by a plurality of struts of substantially equal lengths and arranged in layered arrays, wherein
the said nodes are derived from a regular p-sided prism, termed source prism, of any height and projected on to any curved surface of revolution, wherein
said source prism is composed of (p+2) faces, termed source faces and comprising a top and bottom regular p-sided polygonal face joined by p rectangular side faces, 3*p* edges, termed source edges and comprising p edges each on the top and bottom faces joined by p edges along said side faces, and 2*p* vertices, termed source vertices and comprising p vertices each on said top and bottom faces.
said surface of revolution has attachment locations for said struts, where said attachment locations correspond to the said source faces, said source edges and said source vertices,
the directions of said struts are determined by any combination of axes obtained by joining the center of the said surface of revolution to any combination of points lying on the said surface of revolution and selected from the group comprising:
the points corresponding to the said source vertices,
the points corresponding to the mid-points of the said source faces,
the points corresponding to the mid-points of the said source edges,
or other positions on the said surface of revolution,
wherein p is any number selected from the group consisting of:
odd number greater than 3 when said arrays are non-periodic,
even number greater than 6 when said arrays are non-periodic,
odd number greater than 3 when said arrays are periodic, and
even number greater than 8 when said arrays are periodic.

8. A building system according to claim 7, wherein the said surface of revolution is any curved surface which includes the following:
any quadric surface including:
a sphere,
an ellipsoid,
or a cylinder,
any super-quadric surface
a surface of revolution derived from other curves.

9. A building system according to claim 7, wherein the said nodes comprise flat faces obtained by truncating the said surfaces of revolution by a planes perpendicular to or at an angle to any combination of said axes.

10. A building system according to claims 1 or 7, wherein
the said node shape is derived from radial planes of the said source prism, wherein
said radial planes pass through the center of said source prism and are selected from the group comprising:
planes joining the source edges to the said center,
planes joining the mid-points of the said source faces and the mid-points of the said source edges to the said center,
planes joining the mid-points of the said source faces and the said source vertices to the said center, or
any combination of above.

11. A building system according to claims 1 or 7, wherein
the said nodes are coupled to the said struts by any coupling device, mechanical or otherwise, wherein
the said coupling devices comprise protrusions or indentations on the node.

12. A building system according to claims 1 or 7, wherein
the said nodes and struts are solid or hollow.

13. A building space frame system according to claims 1 or 7, wherein
the cross-section of the said struts is any profile including the group comprising the following:
a polygon,
a circle,
or a standard section.

14. A building space frame system according to claims 1 or 7, wherein the longitudinal section of the strut is uniformly even or variable.

15. A building system according to claims 1 or 7, wherein
polygonal areas enclosed by said struts are stabilized by triangulation.

16. A building system according to claim 15, wherein the said triangulation is achieved by introducing (s−3) diagonals of various lengths, and wherein
s is the number of sides of the said polygonal areas and equals any number greater than 3.

17. A building system according to claim 15, wherein the said polygonal areas are decomposed into rhombii, and wherein
the said rhombii are stabilized by inserting a diagonal.

18. A building system according to claim 15, wherein the said triangulation is achieved by criss-crossing diagonal cables.

* * * * *